US005741753A

United States Patent [19]

Hois et al.

[11] Patent Number: 5,741,753

[45] Date of Patent: Apr. 21, 1998

[54] NITRATE-FREE CATALYST FOR THE WASH-AND-WEAR FINISHING OF TEXTILES

[75] Inventors: Pia Hois, Birkenau; Toni Simenc, Mannheim, both of Germany

[73] Assignee: BASF Aktiengesellschaft, Ludwigshafen, Germany

[21] Appl. No.: 647,901

[22] PCT Filed: Dec. 1, 1994

[86] PCT No.: PCT/EP94/04003

§ 371 Date: Jun. 6, 1996

§ 102(e) Date: Jun. 6, 1996

[87] PCT Pub. No.: WO95/16068

PCT Pub. Date: Jun. 15, 1995

[30] Foreign Application Priority Data

Dec. 10, 1993 [DE] Germany ..... 43 42 126.1

[51] Int. Cl.[6] ..... B01J 27/138; B01J 21/02; D06M 13/00; D06M 9/00

[52] U.S. Cl. ..... 502/226; 502/203; 502/202; 502/217; 8/120; 252/8.61

[58] Field of Search ..... 502/202, 203, 502/217, 226; 8/120; 252/8.61

[56] References Cited

U.S. PATENT DOCUMENTS 3,807,952 4/1974 Lauchenauer ..... 8/186
5,246,904 9/1993 Hois et al. ..... 502/203

FOREIGN PATENT DOCUMENTS 515900 12/1992 European Pat. Off. ..... D06M 13/432

*Primary Examiner*—Elizabeth D. Wood
*Assistant Examiner*—Patricia L. Hailey
*Attorney, Agent, or Firm*—Oblon, Spivak, McClelland, Maier & Neustadt, P.C.

[57] ABSTRACT

Essentially nitrate-free catalyst for the wash-and-wear finishing of textiles with formaldehyde-free crosslinkers, comprising magnesium, tetrafluoroborate, chloride and sulfate ions in the molar weight ratios of (a) $Mg^{2+}$: $BF_4^-$=1:0.1 to 1:4, (b) $Mg^{2+}$: $Cl^-$=1:1.7 to 1:15 and (c) $SO_4^{2-}$: $Cl^-$=1:0.2 to 1:4.

4 Claims, No Drawings

NITRATE-FREE CATALYST FOR THE WASH-AND-WEAR FINISHING OF TEXTILES

The present invention relates to an essentially nitrate-free catalyst for the wash-and-wear finishing of textiles with formaldehyde-free crosslinkers.

Owing to the persistent controversy about the use of formaldehyde-containing auxiliaries in the textile industry, there is an increasing trend in the wash-and-wear finishing of textiles toward using formaldehyde-free crosslinkers, for example those of the formula I

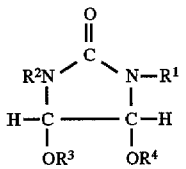

(I)

where $R^1$ and $R^2$ are each hydrogen or $C_1$–$C_3$-alkyl, with the proviso that at least one of $R^1$ and $R^2$ is $C_1$–$C_3$-alkyl, and $R^3$ and $R^4$ are each hydrogen or $C_1$–$C_4$-alkyl.

However, under textile bulk-scale production conditions, the finished material is occasionally observed to give off an extremely unpleasant odor, which was not noticed in the market launch phase of these crosslinkers. This odor is apparently the result of a catalytic decomposition of the crosslinker at elevated (curing) temperatures. The decomposition products are highly volatile compounds which are responsible for the odor nuisance manifest in the finished material—especially already made-up and airtightly packaged merchandise.

EP-A 515 900 discloses a chloride-free catalyst for the wash-and-wear finishing of textiles with formaldehyde-free crosslinkers comprising magnesium and tetrafluoroborate ions in a molar weight ratio of from 1:0.1 to 1:4. This catalyst does in many cases bring about a significant reduction in the odor problem mentioned, but further improvement would be desirable. Furthermore, the finishing properties are still in need of further improvement.

It is an object of the present invention to provide a catalyst system giving more effective avoidance of the odor nuisance and having still better finishing properties.

We have found that this object is achieved by an essentially nitrate-free catalyst for the wash-and-wear finishing of textiles with formaldehyde-free crosslinkers, comprising magnesium, tetrafluoroborate, chloride and sulfate ions in the molar weight ratios of (a) $Mg^{2+}$: $BF_4^-$=1:0.1 to 1:4, (b) $Mg^{2+}$: $Cl^-$=1:1.7 to 1:15 and (c) $SO_4^{2-}$: $Cl^-$=1:0.2 to 1:4.

In a preferred embodiment, the essentially nitrate-free catalyst used comprises magnesium, tetrafluoroborate, chloride and sulfate ions in the molar weight ratios of (a) $Mg^{2+}$: $BF_4^-$=1:0.2 to 1:2, in particular 1:0.4 to 1:1.5, especially 1:0.45 to 1:0.8, (b) $Mg^{2+}$: $Cl^-$=1:1.9 to 1:12, in particular 1:2.0 to 1:5, especially 1:2.05 to 1:3, and (c) $SO_4^{2-}$: $Cl^-$=1:0.3 to 1:3, in particular 1:0.4 to 1:2, especially 1:0.5 to 1:1.0.

The molar weight ratio is defined as the ratio of the respective products $P_i$ of the ion varieties i under consideration, $P_i$ being calculated by the equation $$P_i = \frac{\text{Formula weight of ion variety } i}{\text{Formula weight of } i\text{-containing salt}} \times \text{amount used of } i\text{-containing salt}$$

If an ion variety i occurs in more than one of the salts used, the products $P_i$ of this ion variety are summed before the ratio is formed.

The catalyst of this invention is preferably used in the form of an aqueous solution comprising from 15 to 40% by weight, preferably from 20 to 35% by weight, of salt. The magnesium, tetrafluoroborate, chloride and sulfate ions may be introduced into such a solution in salt form, for example as magnesium sulfate, chloride, phosphate, acetate, glycolate, citrate or adipate, sodium chloride, potassium chloride, lithium chloride or zinc chloride or sodium tetrafluoroborate, lithium tetrafluoroborate, potassium tetrafluoroborate or zinc tetrafluoroborate. Particular preference is given to the use of magnesium sulfate, sodium chloride, lithium chloride and sodium tetrafluoroborate.

The absence of nitrate ions has a beneficial effect on the lightfastness of the finished textiles.

The catalyst of this invention is used in the wash-and-wear finishing of textiles, especially of cotton and cotton-polyester blend fabrics, in the manner which is customary for example for magnesium chloride; the amounts used range from about 30 to 50 parts by weight of a, for example, 20% strength by weight solution, based on 100 parts by weight of the crosslinker (45% strength by weight solution). The catalyst of this invention requires no departure from existing methods of wash-and-wear finishing.

The present invention also provides a process for the wash-and-wear finishing of textiles with formaldehyde-free crosslinkers, which comprises using the catalyst of this invention.

EXAMPLES

A cotton fabric (100 g/m$^2$) was impregnated using a pad-mangle, wet pickup about 80%, with the following solutions:

catalyst solution 1:

5.0 parts by weight of $MgSO_4$ anhydrous 2.5 parts by weight of LiCl 0.6 part by weight of $NaBF_4$ 21.9 parts by weight of $H_2O$ catalyst solution 2:

6.0 parts by weight of $MgSO_4$ anhydrous 1.0 part by weight of LiCl 3.0 parts by weight of NaCl 0.8 part by weight of $NaBF_4$ 19.2 parts by weight of $H_2O$ catalyst solution 3: 5.0 parts by weight of $MgSO_4$ anhydrous 5.0 parts by weight of NaCl 1.0 part by weight of $NaBF_4$ 19.0 parts by weight of $H_2O$ Catalyst solutions A and B were prepared for comparison:

A) 12.0 parts by weight of $MgCl_2.6H_2O$
18.0 parts by weight of $H_2O$

B) 10.0 parts by weight of $MgCl_2.6H_2O$
0.2 part by weight of $NaBF_4$
19.8 parts by weight of $H_2O$ The molar weight ratios (a) to (c) were:

| | (a) $Mg^{2+}$:$BF_4$— | (b) $Mg^{2+}$:Cl— | (c) $SO_4^{2}$—:Cl— |
|---|---|---|---|
| Catalyst solution 1 | 1:0.47 | 1:2.07 | 1:0.52 |
| Catalyst solution 2 | 1:0.52 | 1:2.19 | 1:0.55 |
| Catalyst solution 3 | 1:0.78 | 1:3.0 | 1:0.76 |
| Catalyst solution A | — | 1:1.46 | — |
| Catalyst solution B | 1:0.13 | 1:1.46 | — |

40 parts by weight were used of each of the catalyst solutions 1 to 3 of this invention and of comparative solutions A and B. The amount used of formaldehyde-free crosslinker of the formula I ($R^1$=$R^2$=$CH_3$, $R^3$=$R^4$=H) was in all cases 100 parts by weight of active ingredient, used in the form of a 45% strength by weight aqueous solution.

The crosslinking was carried out at 150° C. for 4 min.

The finished material was packed airtightly in polyethylene sheeting, stored for 14 hours and then subjected to an odor test. The samples treated with catalyst solutions 1 to 3 were odorless, but those treated with comparative catalysts A and B had an extremely unpleasant odor.

The table below shows the finishing results:

| | Crosslinking with catalyst solution | | | Crosslinking with comparative catalyst | | uncross- |
|---|---|---|---|---|---|---|
| | 1 | 2 | 3 | A | B | linked |
| Dry crease angle (warp + weft) [°] | 213 | 209 | 207 | 207 | 215 | 120 |
| Monsanto image after maschine wash at 60° C. [Rating] | 3.2 | 3.0 | 3.0 | 3.0 | 3.2 | 1.0 |

-continued

| | Crosslinking with catalyst solution | | | Crosslinking with comparative catalyst | | uncross- |
|---|---|---|---|---|---|---|
| | 1 | 2 | 3 | A | B | linked |
| Breaking strength (weft) [N] | 270 | 290 | 295 | 280 | 270 | 355 |
| shrinkage after maschine wash at 60° C. (20 min): | | | | | | |
| warp [%] | 0.8 | 1.0 | 1.2 | 1.0 | 0.8 | 7.0 |
| weft [%] | 0.4 | 0.4 | 0.4 | 0.4 | 0.4 | 3.6 |

We claim:

1. A nitrate-free catalyst for the wash-and-wear finishing of textiles with formaldehyde-free crosslinkers, comprising magnesium, tetrafluoroborate, chloride and sulfate ions in the molar weight ratios of (a) $Mg^{2+}$: $BF_4^-$=1:0.1 to 1:4, (b) $Mg^{2+}$: $Cl^-$=1:1.7 to 1:15 and (c) $SO_4^{2-}$: $Cl^-$=1:0.2 to 1:4.

2. A catalyst as claimed in claim 1, comprising magnesium, tetrafluoroborate, chloride and sulfate ions in the molar weight ratios of (a) $Mg^{2+}$: $BF_4^-$=1:0.2 to 1:2, (b) $Mg^{2+}$: $Cl^-$=1:1.9 to 1:12 and (c) $SO_4^{2-}$: $Cl^{31}$ =1:0.3 to 1:3.

3. A catalyst as claimed in claim 1, as a 20 to 35% strength by weight aqueous solution.

4. A process for the wash-and-wear finishing of textiles with formaldehyde-free crosslinkers, which comprises using a catalyst as claimed in claim 1.

* * * * *